United States Patent [19]

Barr

[11] 4,122,693

[45] Oct. 31, 1978

[54] SHACKLE GUARD FOR PADLOCKS

[76] Inventor: Rolla W. Barr, 16300 Fontaine Dr., Chesterfield, Mo. 63017

[21] Appl. No.: 859,309

[22] Filed: Dec. 12, 1977

[51] Int. Cl.[2] ..... E05B 67/38

[52] U.S. Cl. ..... 70/56

[58] Field of Search ..... 70/2-13, 70/51-52, 54-56, 417; 292/281

[56] References Cited

U.S. PATENT DOCUMENTS

| | | | |
|---|---|---|---|
| 3,808,847 | 5/1974 | Vesely | 70/18 |
| 3,828,591 | 8/1974 | Beaver | 70/56 |
| 4,033,155 | 7/1977 | De Lucia | 70/56 |

*Primary Examiner*—Robert L. Wolfe

*Attorney, Agent, or Firm*—James R. Bell

[57] ABSTRACT

A shackle guard is provided for a padlock. The guard includes a housing having a cavity in one end. Reliefs are provided in the housing for receiving, into the cavity, a shackle portion of a padlock and a member to be secured by the padlock. A shackle-securing member is provided in the housing for securing the shackle within the cavity.

15 Claims, 8 Drawing Figures

SHACKLE GUARD FOR PADLOCKS

BACKGROUND OF THE INVENTION

1. Field of the Invention

This invention relates generally to locks of the portable padlock type and more particularly to accessories such as protective devices for such locks.

2. Description of the Prior Art

In the past, protective devices have been provided for portable padlocks. One such device provides an insert to be secured within the loop formed by the shackle portion of the lock to prevent an instrument from being inserted through the loop for prying the lock open. However, such an insert device does not shield the shackle from being cut or otherwise tampered with since the shackle is substantially exposed. For example, a sharp blow applied to the body of the lock can sometimes disengage the shackle from the lock.

In view of the above, it would be advantageous to provide a shield or cover for guarding and protecting the shackle portion of a padlock which overcomes the problems associated with the prior art.

SUMMARY OF THE INVENTION

The present invention is directed to overcoming one or more of the problems as set forth above.

According to the present invention this is accomplished by providing a protective device for padlocks. The device is generally in the form of a covering shield for guarding and protecting the shackle portion of the lock without interfering with the ability of the shackle to be secured to an associated member to be locked. The device includes a housing having a cavity in one end. A first relief is provided for receiving, into the cavity, a shackle portion of a padlock. A second relief is provided for receiving, into the cavity, a member to be secured by the padlock. A shackle-securing member is provided in the housing for securing the shackle within the cavity.

The foregoing and other advantages will become apparent from the following detailed description of the invention when considered in conjunction with the accompanying drawings. It is to be expressly understood, however, that the drawings are not intended as a definition of the invention but are for the purpose of illustration only.

DETAILED DESCRIPTION

Figure 1:
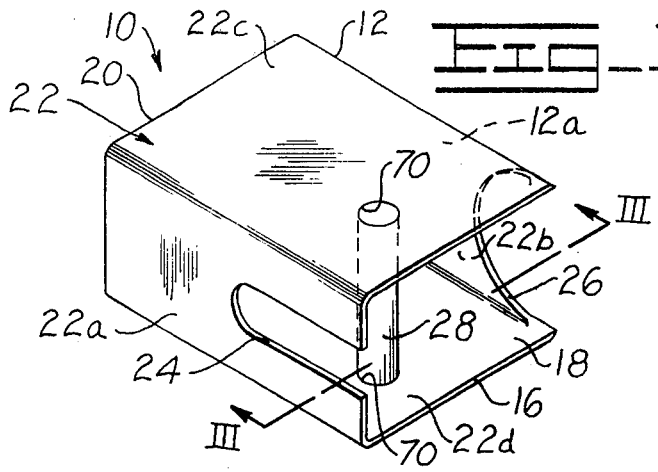
FIG. 1 is an isometric view illustrating an embodiment of the shackle guard of this invention.
Figure 3:
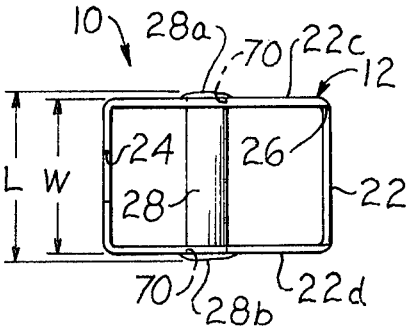
FIG. 3 is an end view of the shackle guard taken along the line III—III of FIG. 1.

It can be seen by referring to FIGS. 1 and 3 that a shackle guard, generally designated 10, comprises a housing 12 preferably having a substantially rectangular cross-section. However, the cross-sectional configuration may vary but should include at least one outer surface 12*a* which is substantially flat. The rectangular shape is convenient since the housing is preferably formed of a section of low-carbon steel tubing. If desirable, the housing can be made of any suitable metal or even a synthetic material. The size of the tubing must be sufficient to accommodate a shackle portion of a lock as will be discussed later in greater detail.

At least one end 16 of housing 12 includes a cavity 18 formed therein. In the preferred form, of course, where a rectangular section of steel tubing is used to form housing 12, cavity 18 extends through housing 12 from the one end 16 to an opposite end 20. However, it is anticipated that alternative type housings may be used which are not formed of a tubing section and thus a cavity 18 must be formed in the one end 16.

Figure 1A:
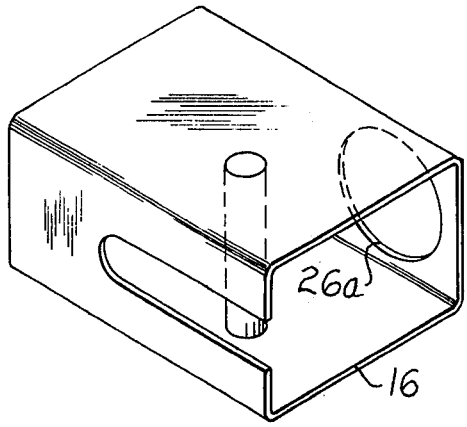
FIG. 1A is an isometric view illustrating another embodiment of the shackle guard of this invention.

The cavity 18 in housing 12 has a sidewall 22 formed therearound terminating at the one end 16. Sidewall 22 has opposed portions 22*a*, 22*b* and opposed portions 22*c*, 22*d*. A first relief 24 is formed in portion 22*a* of sidewall 22. Relief 24 is in open communication with the one end 16 and extends therefrom toward the opposite end 20. First relief 24 is of a construction sufficient for receiving into cavity 18, a shackle portion of a padlock, to be discussed later. A second relief 26 is formed in portion 22*b* opposite portion 22*a* of sidewall 22. Relief 26 is in open communication with the one end 16 and extends therefrom toward the opposite end 20. Second relief 26 is of a construction sufficient for receiving into cavity 18, an associated member to be secured by a padlock, to be discussed later. Alternatively, as shown in FIG. 1A, second relief 26*a* may be spaced from the one end 16 if desired.

A shackle-securing means such as pin 28 is preferably formed of a cold rolled low-carbon steel cut from bar stock. Pin 28 is secured in holes 70 formed in sidewall portions 22*c*, 22*d* of the housing 12, and is recessed within cavity 18 for securing a shackle portion of a lock within cavity 18.

Figure 2:
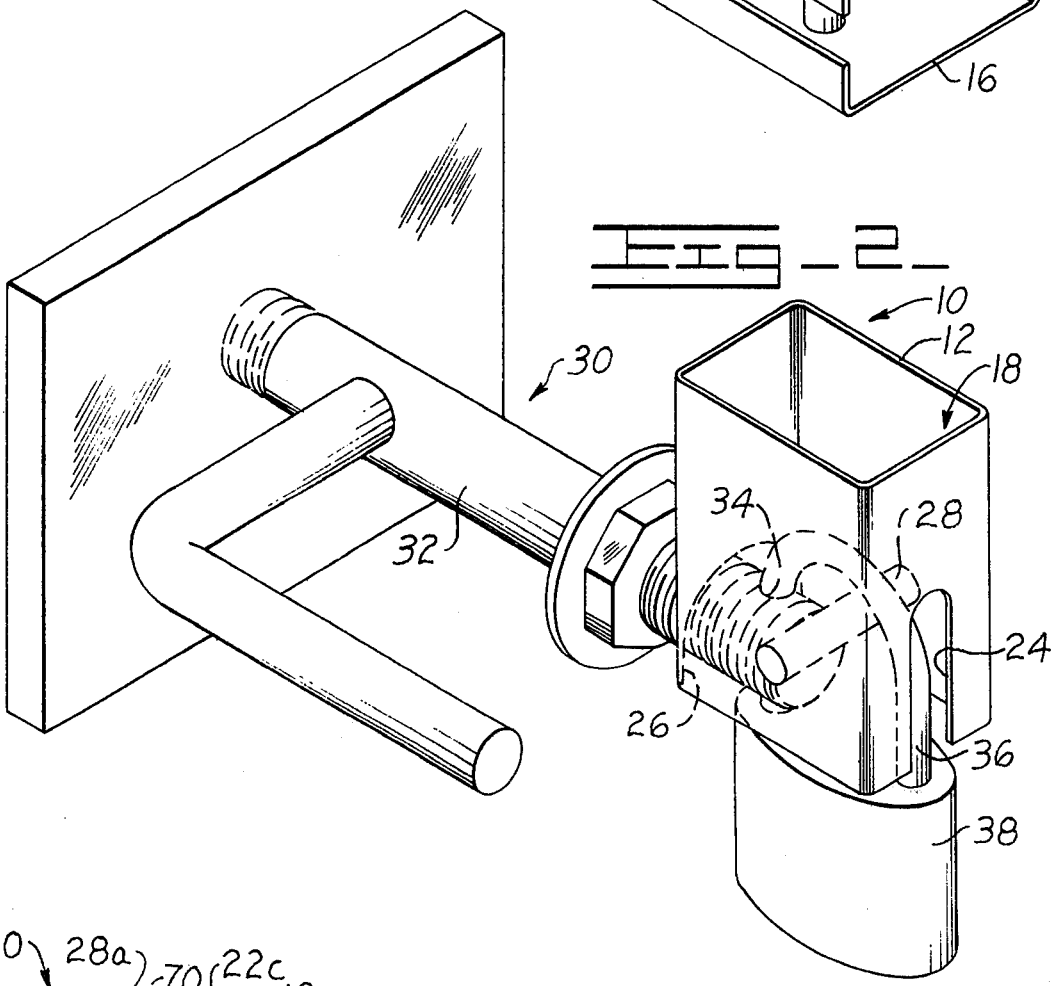
FIG. 2 is an isometric view illustrating the shackle guard of this invention in combination with a padlock and an associated member secured by the padlock.

FIG. 2 illustrates how the shackle guard 10 can be used in combination with an associated member such as a spare tire securing device generally designated 30 and shown and described in allowed U.S. Patent application Ser. No. 719,997 filed Sept. 2, 1976 by Rolla W. Barr, entitled "Device for Securing Spare Tires" and incorporated by reference herein. As shown, second relief 26 receives into cavity 18, elongated member 32. A hole 34 formed in member 32 can receive shackle portion 36 of padlock 38. Shackle 36 is received into cavity 18 through first relief 24. The shackle engages pin 28 and then passes through hole 34. When the shackle 36 is snapped into locked engagement with padlock 38, the housing 12 substantially covers and guards shackle 36 which becomes secured within cavity 18.

Figure 4:
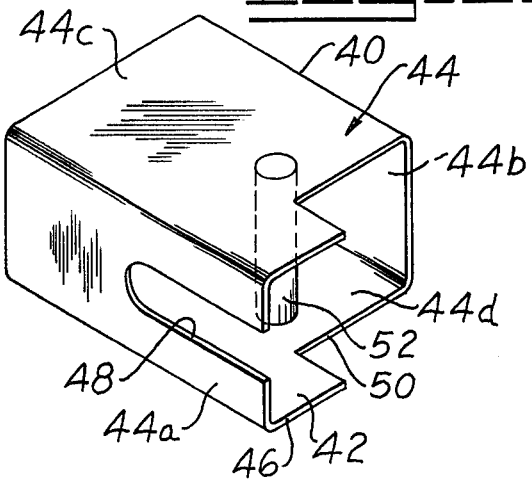
FIG. 4 is an isometric view illustrating a further embodiment of the shackle guard of this invention.
Figure 4A:
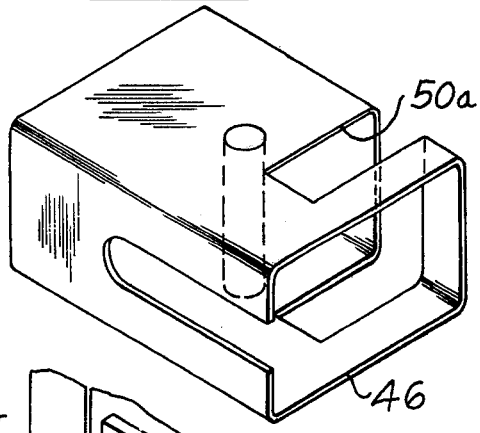
FIG. 4A is an isometric view illustrating a still further embodiment of the shackle guard of this invention.
Figure 5:
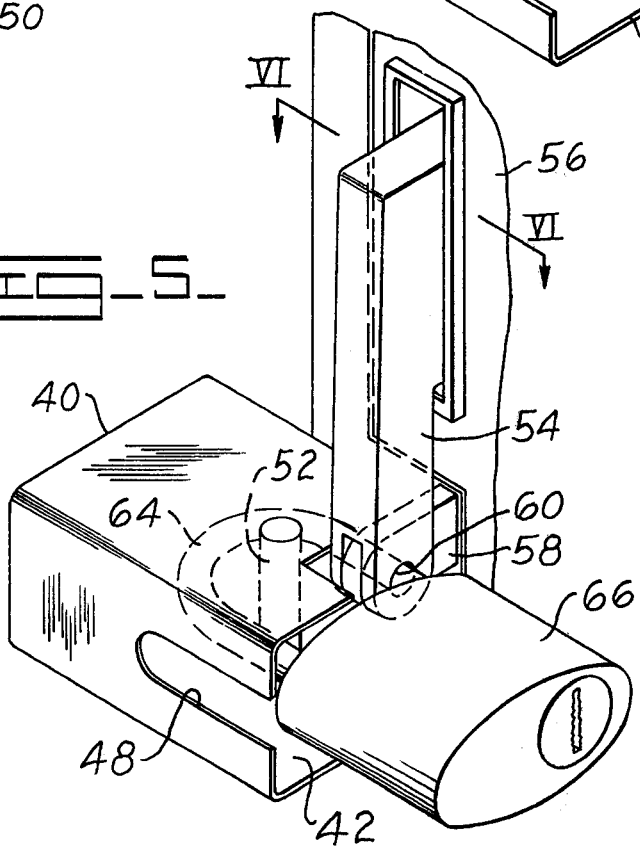
FIG. 5 is an isometric view illustrating the shackle guard of this invention in combination with a padlock and an associated member to be secured by the padlock.
Figure 6:
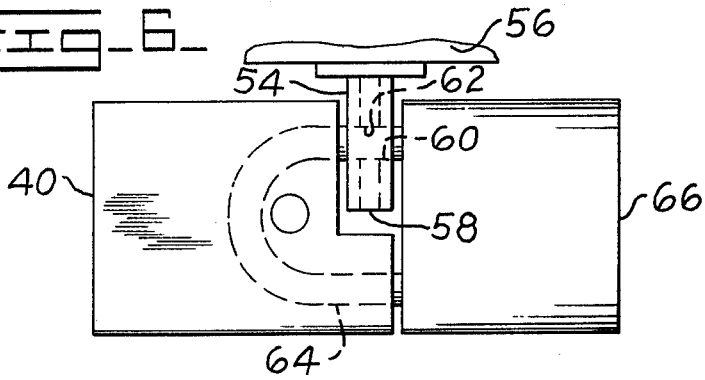
FIG. 6 is a top view of the shackle guard taken along the line VI—VI of FIG. 5.

Referring now to FIG. 4, it can be seen that housing 40 includes a cavity 42 formed therein. Cavity 42 has a sidewall 44 formed therearound terminating at one end 46. Sidewall 44 has opposed portions 44*a*, 44*b* and 44*c*, 44*d*. A first relief 48 is formed in portion 44*a*. Relief 48 is in open communication with the one end 46 and is of a construction sufficient for receiving into cavity 42, a shackle portion of a padlock as previously discussed. A second relief 50 is formed in portions 44*b*, 44*c* and 44*d* of sidewall 44. Relief 50 is in open communication with the one end 46 and is of a construction sufficient for receiving into cavity 42, an associated member to be secured by a padlock. Alternatively, as shown in FIG. 4A, second relief 50*a* may be spaced from the one end 46 if desired. A shackle-securing means such as pin 52 is secured in housing 40 between sidewall portions 44*c* and 44*d* and is recessed within cavity 42 for securing a shackle portion of a lock within cavity 42. Second relief 50, when compared with second relief 26, illustrates that the shape of the second reliefs can be varied to accommodate various associated members to be secured by a padlock. For example, it is shown in FIGS. 5 and 6 that the shackle guard 10 can be used in combination with an associated member such as a handle 54 of a commonly-known wall locker 56. Handle 54 is mounted in sliding relationship with locker 56 and with a fixed tab 58. As it is well known, handle 54 includes a bore 60 therethrough which, when aligned with bore 62 of tab 58, can accommodate a shackle portion 64 of a padlock 66. The padlock 66 may, of course, be of the key opening type or may be of the number combination type. Thus, when shackle 64 is received into cavity 42 through first relief 48, the shackle can engage pin 52 and pass through aligned bores 60, 62. Snapping of shackle 64 into locked engagement with padlock 66 secures shackle 64 within cavity 42 so that housing 40 substantially covers and guards shackle 64.

As an example, making housing 12 in its preferred form requires cutting a section of low-carbon steel tubing which may vary in length between the one end 16 and its opposite end 20. Also the thickness of sidewall 22 may be varied. First relief 24 and second relief 26 may be formed through sidewall portions 22*a*, 22*b*, respectively, by a milling cutter or an end mill, and the reliefs deburred. Holes 70 for pin 28 may be formed through sidewall portions 22*c*, 22*d* by a drill jig. Pin 28 preferably has a length "L" greater than the width W between opposed sidewall portions 22*c*, 22*d*, see FIG. 3. In this manner, a well known peening process can be used to stake, swedge or swell the ends 28*a*, 28*b* of pin 28 thus securing pin 28 in housing 12.

Of course, many other methods may be used to secure pin 28 in housing 12 such as welding or the like. If housings 12 are to be mass produced, a die and punch press may be used to stamp out reliefs 24, 26 and holes 70 in a single operation, and a second operation as described above can secure pin 28 in the housing.

Upon assembly of pin 28 in housing 12, a suitable process may be used to case harden the shackle guard. The process should be applied to case hardened all exposed surfaces of the guard 10, but retain a soft core therebetween so that the sidewall 22 is not unnecessarily brittle. The advantageous case-hardening aids shackle guard 10 in resisting tampering by various means such as cutting or prying. Thus, the result is a substantially tamper-resistant shackle guard for padlocks.

The foregoing has described a protective device for padlocks in the form of a covering shield for guarding and protecting the shackle portion of the lock without interfering with the ability of the shackle to be secured to as associated member to be locked.

The embodiments of the invention in which an exclusive property or privilege is claimed are defined as follows:

1. A shackle guard for padlocks comprising:

a housing having a cavity in one end thereof, a first relief in the housing adjacent the one end for receiving, into the cavity, a shackle portion of an associated padlock, and a second relief in the housing opposite the first relief and adjacent the one end for receiving, into the cavity, an associated member to be secured by the padlock; and shackle-securing means connected in the housing for releasably securing the shackle within the cavity.

2. The shackle guard of claim 1 wherein the shackle-securing means is recessed within the cavity.

3. The shackle guard of claim 1 wherein the housing has a rectangular cross-section.

4. The shackle guard of claim 1 wherein the housing has at least one outer flat surface.

5. The shackle guard of claim 1 wherein the first and second reliefs are in open communication with the one end.

6. The shackle guard of claim 1 wherein the first relief is in open communication with the one end and the second relief is spaced from the one end.

7. In combination with a padlock and an associated member secured by the padlock, a shackle guard comprising:

a housing having a cavity in one end thereof, a first relief in the housing adjacent the one end for receiving, into the cavity, a shackle portion of the padlock, and a second relief in the housing opposite the first relief and adjacent the one end for receiving, into the cavity, the associated member; and shackle-securing means connected to the housing for releasably securing the shackle within the cavity.

8. The combination of claim 7 wherein the shackle-securing means is recessed within the cavity.

9. The combination of claim 7 wherein the first and second reliefs are in open communication with the one end.

10. The combination of claim 7 wherein the first relief is in open communication with the one end and the second relief is spaced from the one end.

11. A shackle guard for padlocks comprising:

a housing having a cavity in one end thereof;

a sidewall surrounding the cavity and terminating at the one end, the sidewall including opposed first and second reliefs formed therethrough adjacent the one end; and shackle-securing means connected to the housing and recessed within the cavity for releasably securing the shackle within the cavity.

12. The shackle guard of claim 11 wherein the first and second reliefs are in open communication with the one end.

13. The shackle guard of claim 11 wherein the first relief is in open communication with the one end and the second relief is spaced from the one end.

14. A shackle guard for padlocks including a housing defining a cavity therein and a wall surrounding the cavity, the improvement comprising:

the wall defining first means in open communication with one end of the housing for permitting a shackle portion of a padlock to pass therethrough into and out of the cavity;

the wall further defining second means, opposite the first means and in open communication with the one end for permitting a member to be secured by the padlock to pass therethrough into and out of the cavity; and means connected to the housing for releasably securing the shackle within the cavity.

15. A shackle guard for padlocks including a housing defining a cavity therein and a wall surrounding the cavity, the improvement comprising:

the wall defining first means in open communication with one end of the housing for permitting a shackle portion of the padlock to pass therethrough into and out of the cavity; and the wall further defining second means, opposite the first means and spaced from the one end for permitting a member to be secured by the padlock to pass therethrough into and out of the cavity.

* * * * *